US006238608B1

(12) United States Patent
Haeller et al.

(10) Patent No.: US 6,238,608 B1
(45) Date of Patent: May 29, 2001

(54) METHOD FOR PRODUCING POLYAMIDE MONOFILAMENTS AND MONOFILAMENT FOR TECHNICAL FABRIC

(75) Inventors: Werner Haeller, Edilbach (CH); Gérard Lagarrigue, Saint Juéry (FR)

(73) Assignee: Rhodia Filtec AG, Emmenbruecke (CH)

( * ) Notice: Subject to any disclaimer, the term of this patent is extended or adjusted under 35 U.S.C. 154(b) by 0 days.

(21) Appl. No.: 09/380,451

(22) PCT Filed: Mar. 16, 1998

(86) PCT No.: PCT/CH98/00100

§ 371 Date: Sep. 2, 1999

§ 102(e) Date: Sep. 2, 1999

(87) PCT Pub. No.: WO98/42900

PCT Pub. Date: Oct. 1, 1998

(30) Foreign Application Priority Data

Mar. 20, 1997 (CH) ..... 669/97

(51) Int. Cl.[7] ..... D01D 5/088; D01F 1/10; D01F 6/90

(52) U.S. Cl. ..... 264/178 F; 264/211

(58) Field of Search ..... 264/178 F, 211

(56) References Cited

U.S. PATENT DOCUMENTS 5,262,099 11/1993 Adams et al. .

FOREIGN PATENT DOCUMENTS

2107406 * 9/1971 (DE) .
2254408 * 5/1974 (DE) .
230228 * 7/1987 (EP) .

OTHER PUBLICATIONS

Abstract of Japan 59–157314 (Sep. 6, 1984).*
Abstract of Japan 6–73612 (Mar. 15, 1994).*
Abstract of Japan 8–81823 (Mar. 26, 1996).*

* cited by examiner

*Primary Examiner*—Leo B. Tentoni
(74) *Attorney, Agent, or Firm*—Michael J. Striker

(57) ABSTRACT

The process produces vacuole-free coarse polyamide monofilaments having diameters of from 0.8 to 1.5 mm. It includes preparing a mixture including from 75 to 85 percent by weight polyamide 66 and from 25 to 5 percent by weight polyamide 6; immediately after preparing the mixture, extruding and spinning it to form crude monofilaments and after the extruding and spinning, cooling down the crude monofilaments in a liquid. Addition of at least 30 ppm of Cu to the mixture prior to extruding and spinning produces heat-protected coarse monofilaments.

6 Claims, No Drawings

METHOD FOR PRODUCING POLYAMIDE MONOFILAMENTS AND MONOFILAMENT FOR TECHNICAL FABRIC

BACKGROUND OF THE INVENTION

1. Field of the Invention

The invention relates to a process for producing vacuole-free, heat-protected, round monofilaments composed of polyamide for industrial fabrics.

2. Prior Art

The production of monofilaments for reinforcing rubber articles, especially for tires, is known. U.S. Pat. No. 5,262,099 discloses a process for producing monofilaments by extrusion into water, which have oval-shaped diameters. Although linear densities of up to 12,000 denier (about 13,000 dtex), corresponding to diameters of about 1.3 mm, are mentioned, the maximum linear density which is exemplified is 6000 denier (about 6700 dtex), corresponding to diameters of about 0.85 mm. The production of monofils>0.8 mm in diameter presents cooling problems with extrusion into water, which become apparent through the formation of vacuoles in the final monofilament. These monofilaments are unsuitable for producing fabrics for industrial purposes, since end breakages are a frequent occurrence and yarn properties are not constant.

EP-A-0 230 228 discloses producing monofils having a round diameter from a mixture of polyamide 66 and polyamide 6 for spiral wires for the paper industry. However, it was found that the total proportion of PA 6 must not exceed 15% by weight. The known process produces polyamide monofils 0.3 to 0.7 mm in diameter. These known diameters are too small to give rise to vacuoles in the monofilament.

There has long been a need to use coarser monofilaments for tire cord. By coarse monofilaments are meant monofilaments having a linear density of more than 8000 dtex, corresponding to a filament diameter of more than about 0.9 mm. The use of PA 6 alone, or copolyamides thereof, did not lead to the desired success. PA 6 alone is on account of its low melting point (about 218° C.) not usable at the contemplated vulcanization temperatures for heavy tires, for example heavy goods vehicle tires.

SUMMARY OF THE INVENTION

It is an object of the present invention to provide a process for producing coarse monofilaments from lightweight synthetic material for use in fabrics for carcasses or other textile inliner materials in heavy tires.

It is a further object to produce such monofilaments economically.

These objects are achieved according to the invention when a mixture of 75–85% by weight of PA 66 and at least 15 to 25% by weight of PA 6 is mixed immediately prior to extrusion, spun and directly cooled down in a liquid.

It has been found that, surprisingly, not a copolyamide, but merely a mixture of different polyamides leads to a vacuole-free coarse monofilament and hence to a very high melting point. The mixing ratio is crucial here. A PA 6 level of 15% by weight or less gives rise to vacuoles which adversely affect the breaking strength of the fabric produced therefrom. A PA 6 content of more than 25% by weight will lower the melting point of the mixture to such an extent that the desired yarn properties and melting point levels are no longer achieved.

It is advantageous to carry out the spinning at an ejection speed of >10 m/min, into a cooling bath having a temperature of <60° C. An ejection speed of less than 10 m/min can give rise to threadline snaps; at more than 20 m/min, the subsequent cooling/drawing process may be compromised.

It is advantageous to add at least 30 ppm, preferably more than 60 ppm, of Cu, but not more than 120 ppm, to the PA 66. The addition of the entire heat protectant embedded in PA 66 polymer pellet has the advantage of thorough final mixing in the monofilament without significant degradation of the polymer and the embedding in the polymer prevents sintering out of the copper, for example onto the extruder tube. The copper is used in the form of a copper salt. The copper salt used is preferably a halide such as copper(II) chloride, bromide or iodide.

It is advantageous to add PA 66 and PA 6 to an extruder, especially a devolatilizing extruder, ready-mixed in pellet form. Here pellet thickness is important for the mixture. Pellet thickness has a significant influence on the expulsion of moisture in the extruder.

An advantageous pellet mixture has a pellet weight of 10 to 200 mg, preferably 10 to 100 mg, especially 15 to 80 mg. A pellet weight of less than 10 mg leads to feed problems on the customary feed screws; a pellet weight of more than 100 mg leads to a poor degree of mixing. Care must be taken here to ensure that the sizes of the PA 66 and PA 6 pellets are substantially the same.

A monofilament for industrial fabrics, having a round cross-section of 0.8 to 1.5 mm, preferably 0.9 to 1.2 mm and a melting point range of 235–260° C., preferably 245–260° C., especially 255–260° C. is particularly useful for producing the fabrics for use as carcasses and breakers in tires. A round cross-section is advantageous over a non-round cross-section in that the monofilament will not become twisted in the course of processing into calendered fabrics. A monofil thickness of <0.8 mm has the disadvantages of insufficient breaking strength and stability; a monofil thickness of >1.5 is impossible to produce.

Methods of measurement:

Relative viscosity $\eta$rel

Method ISO 307–1984 (250 mg sample in 50 ml of 90% strength formic acid)

Thermal resistance

Breaking-strength loss: 7 days' heat treatment at 190° C.

Embodiments of the invention will now be more particularly described by way of example.

EXAMPLE 1

Solid polyamide 6 (PA 6) having a viscosity $\eta$rel=184 and solid polyamide 66 (PA 66) having a viscosity of $\eta$rel 131 are mixed in a ratio of 20/80 on a metering apparatus. The PA 66 includes 100 ppm of Cu as heat protectant. The mixed polymer pellets, having a pellet weight of 14 to 64 mg, are melted in a twin-screw extruder, the moisture is vented out by means of vacuum, and the melt is then extruded via a vertically disposed spin head into a water bath. The diameter of the multi-bore round-hole die is 3.4 mm and the extrusion speed is 12.8 m/min. The crude monofilament is cooled in the water bath at a distance of 80 mm to the die plate and a temperature of 40° C. The monofilament, which is still hot on the inside, is withdrawn from the cooling bath via two feed rolls and fed via a further cooling zone, having a water temperature of 15–20° C., to a drawing process. The monofilament is drawn to a ratio within the range from 1:4 to 1:5 and then relaxed.

EXAMPLE 2

Example 1 is repeated on a 25/75 mixture of solid polyamide (PA 6) having a viscosity $\eta$rel=184 and solid polyamide 66 (PA 66) having a viscosity of ηrel 131. The diameter of the resulting monofilament is 1.2 mm.

EXAMPLE 3

Example 1 is repeated on a 15/85 mixture of solid polyamide 6 (PA 6) having a viscosity ηrel=184 and solid polyamide 66 (PA 66) having a viscosity of ηrel 131. The diameter of the resulting monofilament is 0.9 mm.

EXAMPLE 4 (comparison)

Example 1 is repeated on a 10/90 mixture of solid polyamide 6 (PA 6) having a viscosity ηrel=184 and solid polyamide 66 (PA 66) having a viscosity of ηrel 131. The diameter of the resulting monofilament is 1.0 mm.

The results are summarized below in Table 1.

TABLE 1

| Examples | PA6/PA66 | Diameter [mm] | Tenacity [cN/tex] | Elongation % | TR % BS loss | mp ° C. | Vacuole formation |
|---|---|---|---|---|---|---|---|
| 1 | 20/80 | 1.0 | 46.4 | 22.6 | 53.3 | ≧245 | no |
| 2 | 25/75 | 1.0 | 40 | 21 | <55 | ≧245 | no |
| 3 | 15/85 | 0.9 | 42 | 19 | <55 | ≧245 | no |
| 4 | 10/90 | 1.0 | 45 | 23 | <60 | ≧245 | yes |
| 5 | 25/75 | 1.2 | 35 | 19 | <60 | ≧245 | yes |

Abbreviations:
TR = Thermal resistance
BS = Breaking strength
mp = melting point The monofilament of the invention is particularly useful for producing tire reinforcing fabrics, especially in the warp thereof, but also for paper machine wet-end wires, and also for application in fishing.

What is claimed is:

1. A process for producing vacuole-free heat-protected, round polyamide monofilaments for industrial fabric, said process comprising the steps of:

a) preparing a mixture comprising from 75 to 85 percent by weight polyamide 66 and from 25 to 15 percent by weight polyamide 6;

b) immediately after making said mixture in step a), extruding and spinning said mixture to form crude monofilaments;

c) after the extruding and spinning of step b), cooling down said crude monofilaments in a liquid to form the vacuole-free heat-protected, round polyamide monofilaments.

2. The process as defined in claim 1, wherein said spinning is performed at an ejection speed of greater than 10 m/min and said cooling down of said crude monofilaments takes place at a temperature of less than 60° C. in at least one cooling bath.

3. The process as defined in claim 1, wherein said mixture comprises at least 30 ppm of Cu for heat-protection of said monofilaments.

4. The process as defined in claim 1, wherein said mixture is in pellet form and further comprising adding said mixture ready-mixed to an extruder.

5. The process as defined in claim 4, wherein said mixture consists of pellets and each of said pellets weighs from 10 to 100 mg.

6. The process as defined in claim 1, wherein said mixture is made during the making of the mixture and said extruding, said spinning and said cooling down are performed so that said monofilaments have a diameter of from 0.8 to 1.5 mm, a tenacity of greater than 40 cN/tex, a breaking strength loss of less than 55% and a melting point of from 235 to 260° C.

* * * * *